US007007722B2

(12) United States Patent
Quigley et al.

(10) Patent No.: US 7,007,722 B2
(45) Date of Patent: Mar. 7, 2006

(54) FORMING FABRIC

(75) Inventors: Scott Quigley, Bossier City, LA (US); Jim Kramer, Shreveport, LA (US); James Brewster, Waskom, TX (US); Stewart Lister Hay, Lancs (GB)

(73) Assignee: Voith Paper Patent GmbH, Heidenheim (DE)

( * ) Notice: Subject to any disclaimer, the term of this patent is extended or adjusted under 35 U.S.C. 154(b) by 167 days.

(21) Appl. No.: 10/714,698

(22) Filed: Nov. 17, 2003

(65) Prior Publication Data

US 2005/0103397 A1 May 19, 2005

(51) Int. Cl.
*D21F 3/00* (2006.01)

(52) U.S. Cl. ..... 139/383 A; 139/383 R; 162/358.2; 442/203

(58) Field of Classification Search ..... 139/383 A, 139/383 R; 442/203, 206, 207; 162/358.2, 162/900, 903
See application file for complete search history.

(56) References Cited

U.S. PATENT DOCUMENTS 4,281,688 A * 8/1981 Kelly et al. ..... 139/383 A
4,453,573 A * 6/1984 Thompson ..... 139/383 A
5,555,917 A * 9/1996 Quigley ..... 139/383 A
5,694,980 A * 12/1997 Quigley ..... 139/383 A
5,713,397 A * 2/1998 Quigley ..... 139/383 A
5,826,627 A 10/1998 Seabrook et al. ..... 139/383
5,840,411 A * 11/1998 Stelljes et al. ..... 442/239
6,145,550 A 11/2000 Ward ..... 139/383
6,237,644 B1 * 5/2001 Hay et al. ..... 139/383 A
6,334,467 B1 1/2002 Barrett et al. ..... 139/383
6,834,684 B1 * 12/2004 Martin et al. ..... 139/383 A
6,854,488 B1 * 2/2005 Hay et al. ..... 139/383 A
6,926,043 B1 * 8/2005 Quigley et al. ..... 139/383 A
2003/0024590 A1 2/2003 Stone ..... 139/408
2004/0118473 A1 6/2004 Hay et al. ..... 139/383

* cited by examiner

*Primary Examiner*—John J. Calvert
*Assistant Examiner*—Robert H Muromoto
(74) *Attorney, Agent, or Firm*—Taylor & Aust, P.C.

(57) ABSTRACT

A forming fabric having a set of paper side warp yarns, which interlace with both a set of paper side weft yarns and a set of binder wefts and a set of machine side warp yarns which interlace with a set of machine side weft yarns and the set of binder weft yarns, whereby the binder weft yarns are disposed in groups of at least two, and whereby both binder weft yarns of at least one binder group, in total, form fewer knuckles over the paper side warp yarns than the paper side weft yarns.

25 Claims, 7 Drawing Sheets

FORMING FABRIC

BACKGROUND OF THE INVENTION

1. Field of the Invention

The present invention relates to fabrics employed in web forming equipment, such as papermaking and non-woven web forming equipment, and, more particularly, to forming fabrics in web forming equipment; most preferably in papermaking machines.

2. Description of the Related Art

Paper is conventionally manufactured by conveying a paper furnish, usually consisting of an initial slurry of cellulose fibers, on a forming fabric or between two forming fabrics in a forming section, the nascent sheet then is passed through a pressing section and ultimately through a drying section of a papermaking machine. In the case of standard tissue paper machines, the paper web is transferred from the press fabric to a Yankee dryer cylinder and then creped.

Papermachine fabric is essentially employed to carry the paper web through these various stages of the papermaking machine. In the forming section the fibrous furnish is wet-laid onto a moving forming wire and water is encouraged to drain from it by way of suction boxes and foils. The paper web is then transferred to a press fabric that conveys it through the pressing section, where it usually passes through a series of pressure nips formed by rotating cylindrical press rolls. Water is squeezed from the paper web and into the press fabric as the web and fabric pass through the nip together. In the final stage, the paper web is transferred either to a Yankee dryer, in the case of tissue paper manufacture, or to a set of drying cylinders upon which, aided by the clamping action of the dryer fabric, the majority of the remaining water is evaporated.

So-called "triple-layer" or composite paper machine fabrics are known in the art. These generally include paper side and machine side warp and weft yarn systems, which are bound together by binder yarns.

The binder yarns may be disposed as single additional weft yarns with the exclusive function of binding the discrete fabric layers into a single composite structure. European Patent EP 0 269 070 to JWI, for example, shows such a structure. Because of the practical limitations in the frequency of bindings, between the binder yarns and the warp yarns of the paper side and wear side layers of composite structures with only a single binder yarn, there is a limit to the delamination resistance. Further, in this structure the binder yarns change from weaving above a paper side warp, to weaving below a wear side warp within the space of several warp yarns, such that undesirable basis weight variation may occur in the sheet.

From European Patent EP 1 000 197 binder yarns disposed in pairs are known. According to this document the binder yarns are "integrated" into the papermaking surface and so called integrated binder yarns. The binder yarns of each pair are interwoven with the top and bottom machine direction yarns such that, as a fiber support portion of the first binder yarn is interwoven with the top machine direction yarns, a binding portion of the second binder yarn is positioned below the top machine direction yarns and vice versa. Further, the first and second binder yarns cross each other as they pass below a transitional top machine direction yarn. Although the binder yarns are integrated into the papermaking surface, imperfections in the weave of the "integrated" binders sometimes impart wire marking on the paper sheet.

SUMMARY OF THE INVENTION

The present invention provides a forming fabric with a composite structure not having the drawbacks of the prior art mentioned above.

The present invention comprises, in one form thereof, a forming fabric having a set of paper side warp yarns, which interlace with both a set of paper side weft yarns and a set of binder wefts and a set of machine side warp yarns. The set of machine side warp yarns interlace with a set of machine side weft yarns and the set of binder weft yarns, whereby the binder weft yarns are disposed in groups of at least two, and whereby both binder weft yarns of at least one binder group, in total, form 'fewer knuckles' over the paper side warp yarns than the paper side weft yarns. The term 'fewer knuckles' indicates that the paper side of the forming fabric comprises at least one binder group whose binder weft yarns make less interlacing cycles over paper side warp yarns than interlacing cycles of paper side weft yarns over paper side warp yarns.

The forming fabric, according to one embodiment of the present invention, provides binder groups with at least two binders. Therefore the tendency for delamination of the paper side and wear side layers is reduced due to the increase of binding frequency. Further, the delamination resistance is enhanced due to the use of binder pairs, as opposed to individual binder yarns. This structure provides additional cross machine direction (CD) orientated material for wear, which allows good binding of the fabric layers to be maintained.

Further, by reducing the number of knuckles formed by the binder yarns, when passing over the paper side warp yarns, the probability of wire marking on the paper sheet is reduced. Therefore, according to this embodiment of the present invention, there is provided a composite structure forming fabric having binder groups with at least two binders. Both of the binder weft yarns of at least one binder group do not continue the weave pattern formed by the interlacing paper side weft and paper side warp yarns.

There are different expressions of the present invention that may be utilized to separate the knuckles formed by the two binders of the at least one binder group so that they do not continue the paper side weave pattern formed by the interlacing paper side warp and weft yarns. According to a preferred embodiment of the present invention, both binder weft yarns of the binder group flow below at least two common consecutive paper side warp yarns. It is further possible that the binder wefts flow below a multiple of two common consecutive paper side warp yarns.

To increase the wear resistance on the wear side of the fabric it is advantageous to protect the load bearing wear side warp yarns. To increase the delamination resistance, it is advantageous to provide additional CD orientated material for wear that allows good binding of the fabric layers to be maintained. It is further desirable that the above-mentioned methods, to increase the fabric stability, influence the structure of the paper side of the fabric as little as possible. Therefore, it is desirable to increase the number of passes of binder weft yarns below the wear side warp yarns without increasing the number of knuckles formed by the interlacing binder weft and paper side warp yarns.

According to a preferred embodiment of the invention, the binder wefts of at least one binder group in total pass more often below the wear side warp yarns than above the paper side warp yarns. Based on this embodiment at least one binder of the binder group passes above only one paper side warp yarn (interlaces with only one paper side warp yarn) to form a knuckle and passes below a plurality of wear side warp yarns. Further, it is within the scope of the present invention that each binder weft yarn of at least one binder group pass above only one paper side warp yarn and below a plurality of wear side warp yarns.

According to a further embodiment of the present invention, a binder weft yarn of at least one binder group and a paper side weft yarn, which is positioned adjacent to the binder group form knuckles over a common paper side warp yarn. A binder weft yarn is positioned adjacent to a paper side weft yarn, whereby both yarns pass over a common paper side warp yarn creating on the paper side, a "common" knuckle with double width in respect to a knuckle only formed by a single weft yarn. To reduce wire marking it is advantageous to separate each of the knuckles formed by a single yarn from other knuckles. Therefore, according to a preferred embodiment of the present invention the binder weft yarns and paper side weft yarns are separated by at least one binder weft yarn and/or paper side weft yarn that pass below the common paper side warp yarn.

According to a further embodiment of the present invention, at least one of the binder weft yarns of at least one binder group floats between at least two consecutive pairs of paper side and wear side warp yarns before traveling from the paper side to the wear side of the fabric or vice versa.

A forming fabric with the above mentioned features has the following advantage: The pull down force acting on a paper side warp yarn interlacing with a binder weft yarn, according to the above mentioned embodiment, is reduced, because the binder weft yarn floats between at least two consecutive pairs of paper side and wear side warp yarns before traveling from the paper side to the wear side or vice versa. Thus the probability of forming a recessed area in the paper side fabric surface, into which a fiber can penetrate more deeply than surrounding areas, is reduced. As such, undesirable basis weight variation, which may occur in the sheet, is also reduced.

Furthermore, according to another embodiment of the present invention, a fabric stiffening binder weft section exists when the binder weft yarn, floating between the paper side and wear side fabric layers, beneath at least two consecutive paper side warp yarns, is bound at one end by interlacing with a warp yarn in the paper side layer and is also bound at the other end by interlacing with a warp yarn in the same paper side fabric layer to thereby stiffen the composite fabric. A fabric stiffening binder weft section also exists when a relatively straight length of yarn is bound at each end by a warp yarn of the wear side layer. The triple layer fabrics of the invention are thus stable and have good cross machine direction (CD) bending stiffness with which to control sheet profiles.

According to a further embodiment of the present invention, the forming fabric has at least one paper side weft yarn positioned adjacent to a binder group. The paper side weft yarn floats under at least two consecutive paper side warp yarns and at least one of the binder weft yarns of the binder group forms a knuckle over one of the at least two consecutive warp yarns. A further embodiment of the present invention is characterized in that the paper side weft yarn floats between at least two consecutive pairs of paper side and wear side warp yarns. By providing such a structure, combined with a binder group that is positioned adjacent to the paper side weft yarn, the binder weft yarns form a knuckle over one of the two consecutive paper side warp yarns. A fabric stiffening top weft section is provided, with which to enhance fabric CD stability, while the binder yarn continues the paper side weave sequence otherwise provided for by the paper side weft yarn.

If the paper side weave structure is, for example, a plain weave on the paper side, whereby a paper side CD yarn floats under a single paper side machine direction (MD) yarn as part of the plain weave, a stiffening float length of 3 paper side CD yarns is necessary to allow the binder knuckle to continue the paper side weave pattern.

To increase the paper side smoothness and to increase the abrasion resistance on the wear side of the forming fabric it can be advantageous if yarns have different diameters. Some examples of the yarns that may have different diameters are the paper side warp yarns, the paper side weft yarns, the wear side warp yarns, the wear side weft yarns and/or the binder yarns. It is also possible that only some yarns of the above mentioned yarns types have different yarn diameters, such as some paper side weft yarns having bigger diameters than other paper side weft yarns. Further, it is possible that some of the binder weft yarns of at least one binder group have different yarn diameters.

Preferably, the fabric of the present invention has a 20 warp repeat or greater. Preferred examples of warp repeat sizes are 16, 24, 28, 32, 40 shaft, or greater. The machine side wefts may, for example, make a single binding with the machine side warps over a five warp repeat. However, other wear side weave patterns can be used, for example, six shaft repeat with single interlacing or an eight or ten shaft repeat with either single, multiple adjacent, or multiple non-adjacent warp-weft interlacings.

Further, the paper side weave of the forming fabric can comprise a plain weave, a twill weave or a sateen weave.

The permeability of the forming fabric according to the present invention typically is in the range of 200 to 1000 c.f.m.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrate one preferred embodiment of the invention, in one form, and such exemplifications are not to be construed as limiting the scope of the invention in any manner.

DETAILED DESCRIPTION OF THE INVENTION

Figure 1:
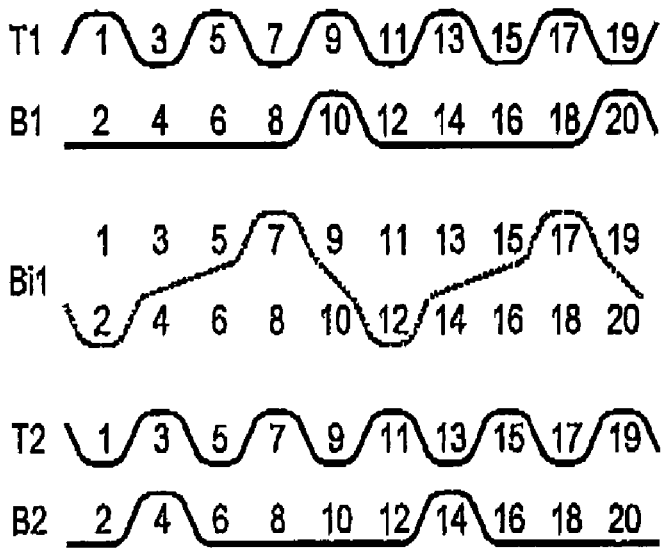
FIG. 1 is a series of warp cross-sectional diagrams showing the consecutive weft paths of a number of wefts in accordance with a prior art composite fabric.

Referring now to the drawings, and, more particularly to FIG. 1, there is shown a series of weft yarns arranged in accordance with a 20 shaft weave.

FIG. 1 shows how each of the weft yarns interacts with the twenty warp yarns in the fabric's warp repeat unit. There is a 1:1 paper side to wear side warp ratio, comprising paper side warps 1, 3, 5, 7, 9, 11, 13, 15, 17 and 19, and machine side warps 2, 4, 6, 8, 10, 12, 14, 16, 18, 20.

The weft yarns fall into three categories. The first set of weft yarns, as exemplified by wefts B1 and B2, bind only with the machine side warps, binding with every fifth wear side warp yarn such that the machine or wear side fabric has a so-called five shaft back. The second set of weft yarns, as exemplified by wefts T1 and T2, bind only with the paper side warps, to each form complete weave repeats in an over-under fashion. Thus, the paper side fabric has a so-called plain weave face.

The remaining weft Bi1, in FIG. 1, provides a binding of the paper side and wear side fabric layers by interlacing with paper side warps 7 and 17 and by interlacing with wear side warps 2 and 12 respectively. In traveling from above paper side warp 7 to underneath wear side warp 12 binder weft Bi1 passes between only a single pair of warp or machine direction (MD) yarns 9 and 10 such that paper side warp 7 may be pulled below the level of other adjacent paper side warp yarns such that an undesirable recessed area may be created. Furthermore, binder Bi1 interlaces with only four warp yarns from a possible 20 such that the number of bindings and therefore the delamination resistance provided by the binder is relatively low.

Figure 2:
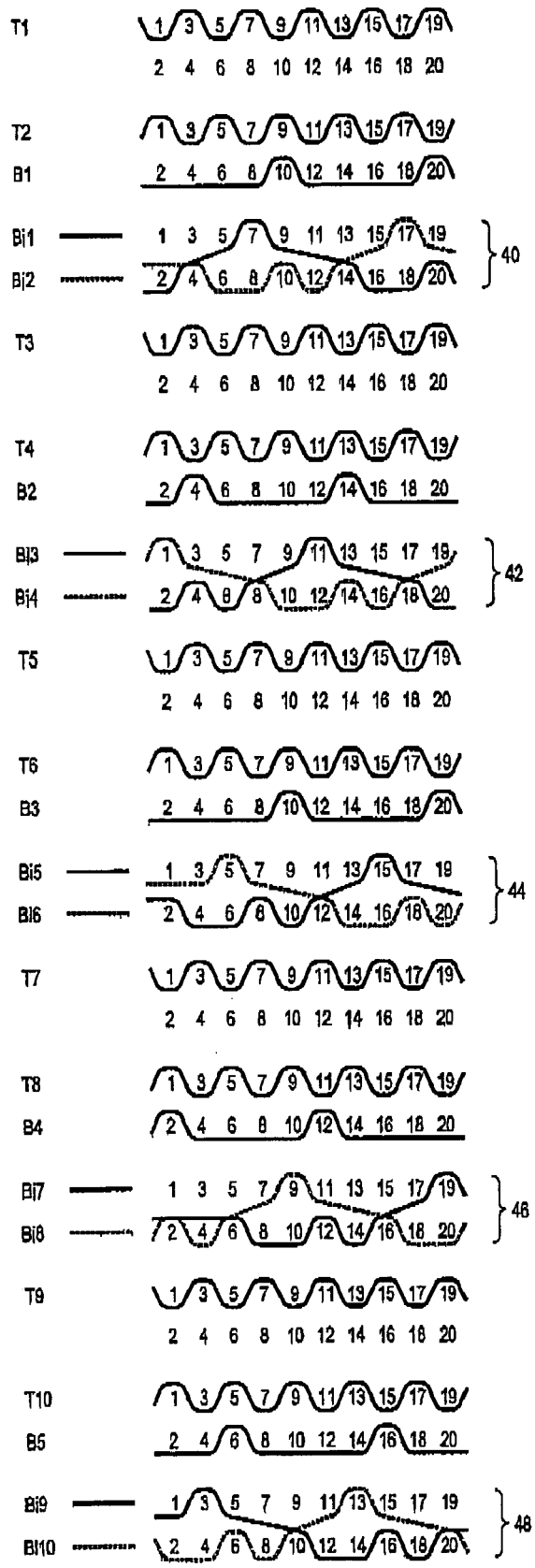
FIG. 2 is a series of warp cross-sectional diagrams showing consecutive weft paths of all of the wefts in a first fabric in accordance with an embodiment of the present invention.

Referring now to FIG. 2 there is illustrated the full weft paths of all 25 weft yarns in a full repeat of a twenty shaft weave, of a first embodiment in accordance with the present invention. The fabric has a 1:1 paper side to wear side warp ratio, comprising paper side warps 1, 3, 5, 7, 9, 11, 13, 15, 17, 19 and machine side warps 2, 4, 6, 8, 10, 12, 14, 16, 18, 20.

The weft yarns fall into three categories. The first set of weft yarns, as exemplified by wefts B1, B2, B3, B4 and B5, bind only with the machine side warps, the weave repeat being over five machine side or wear side yarns. Thus, the fabric has a so-called five shaft back. The basic wear side weave pattern repeats after five wear side weft yarns. However, the overall repeat size may be extended to accommodate alternating or other arrangements of wear side wefts of different materials, such as alternating polyester for stability with polyamide for enhanced abrasion resistance. All embodiments of the invention can be manufactured in this way.

The second set of weft yarns, as exemplified by wefts T1, T2, T3, T4, T5, T6, T7, T8, T9 and T10, bind only with the paper side warps in the paper side fabric where they each weave in an over-under fashion. Thus, the fabric has a so-called plain weave paper surface.

The third set of weft yarns, as exemplified by wefts Bi1, Bi2, Bi3, Bi4, Bi5, Bi6, Bi7, Bi8, Bi9 and Bi10 are disposed in pairs, labeled 40, 42, 44, 46 and 48, and each yarn binds with a paper side warp and with a multiple of wear side warps. In describing the features of the binders, reference will only be made to binder pair 40 as the other binder pairs utilize the same technique and have similar features to pair 40.

First binder Bi1 of binder pair 40 binds the paper side fabric above warp pair 7 and 8 before traveling between three consecutive warp pairs 9 and 10, 11 and 12, and 13 and 14 to interlace with wear side warps 16 and 18 then returns to the fabric center between pair 19 and 20 before making a third wear side interlacing under warp 2 and then returns to the fabric center for two warp pairs 3 and 4, and 5 and 6. Binder Bi1 thus makes a paper side interlacing alongside paper side weft T3, which also binds over warp 7. Binder Bi1 interlaces with a total of three wear side warps 16, 18 and 2. The wear side knuckles of binder Bi1 are locked in position by the action of adjacent wear side warp and weft interlacings, as are the knuckles of all binders in this embodiment. For example, binder Bi1 binds on warp 2 where it is locked in place on one side by the action of adjacent weft B1 with warp 20 and on the other side by the action of weft B2 with warp 4. The remaining Bi1 knuckle under warps 16 and 18 and is similarly locked in place on one side by the action of adjacent weft B1 with warp 20 and on the other side, by the action of weft B2 with warp 14.

Binder Bi2 of binder pair 40 binds the paper side fabric above warp pair 17 and 18 before traveling between three consecutive warp pairs 19 and 20, 1 and 2, and, 3 and 4 to interlace with wear side warps 6 and 8 then returns to the fabric center between pair 9 and 10 before making a third wear side interlacing under warp 12 and then returns to the fabric center between two warp pairs 13 and 14, and 15 and 16. Binder Bi2 thus makes a paper side interlacing alongside paper side weft T2, which also binds over warp 17. Binder Bi2 interlaces with a total of three wear side warps 6, 8 and 12. The wear side bind knuckle on yarns 6 and 8 is locked in place on one side by the action of adjacent weft B1 with warp 10 and on the other side by the action of weft B2 with warp 4. The remaining Bi2 knuckle under warp 12 is similarly locked in place on one side by the action of adjacent weft B1 with warp 10 and on the other side by the action of weft B2 with warp 14. It is not a necessity of the invention that the binder knuckles are so locked on the fabric wear side and any suitable position may be chosen for a binder knuckle on the wear side of the fabric.

Compared with the prior art, it can be seen that the two yarns in binder pair 40 provide an increased total number of bindings with the wear side fabric to minimize a tendency for delamination. Further, it can be seen that the total number of bindings of binder pair 40 with the paper side warp yarns 1, 3, 5, 7, 9, 11, 13, 15, 17 and 19 is less than the number of bindings between paper side wefts T1–T10 and paper side warps 1, 3, 5, 7, 9, 11, 13, 15, 17 and 19, because first binder Bi1 binds only with paper side warp yarn 7 and second binder Bi2 binds only with paper side warp yarn 17 whereby the total number of bindings (knuckles) between the paper side warps 1, 3, 5, 7, 9, 11, 13, 15, 17 and 19 and paper side wefts T1–T10 is five for each of paper side wefts T1–T10. Further, in contrast to the prior art it can be seen that both binders Bi1 and Bi2 of binder pair 40 pass below common consecutive paper side warp yarns 9, 11, 13 and 15. In addition, as described above, binder wefts Bi1 and Bi2, in total, pass below wear side warps 2, 6, 8, 12, 16 and 18 and pass only over paper side warps 7 and 17. Therefore, binder wefts Bi1 and Bi2 pass more often under the wear side warps than passing over the paper side warps. The steepness of the warp passage from paper side to wear side layers is also reduced to thereby minimize the pull down effect, which contributes to recessed regions and wire marks in the paper.

In FIG. 2, referring again to the paper side, warp 7 is bound by both binder Bi1 and paper side weft T3 whereas the paper side warp 17 is bound by both binder Bi2 and paper side weft T2. As such a binder and top weft, which bind on a common paper side warp, are separated by the other member of the binder yarn pair. This feature also reduces the pull on a paper side warp yarn and is applied to the remaining binder pairs 42, 44, 46 and 48 shown in FIG. 2. However, the invention is not limited to positioning common binder and paper side weft interlacings in this way such that, although not shown in FIG. 2, it is possible to insert at least one binder pair so that they form their respective interlacings with paper side warp yarns directly adjacent with paper side weft yarns, which interlace with common paper side warp yarns. In this way the regularity of the distribution of the binder knuckles, from one binder pair to another adjacent binder pair, on the paper side or wear side can be disturbed to break up twill patterns, arising from a regular spacing of knuckles. Such patterns manifest themselves in the paper formed on the fabric of other machines and are considered to be undesirable.

Figure 3:
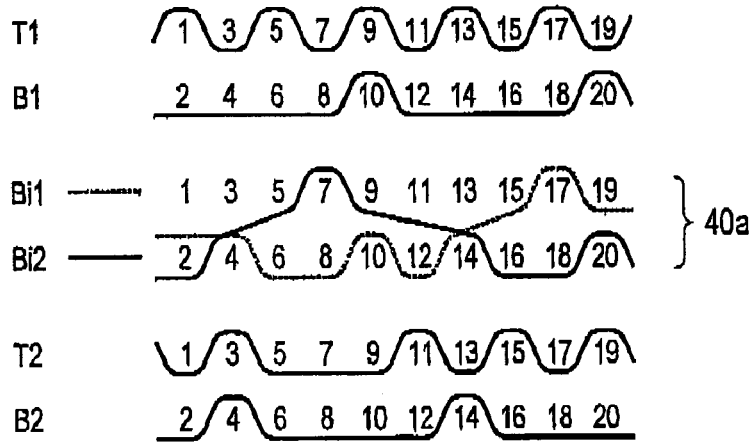
FIG. 3 is a series of warp cross-sectional diagrams showing consecutive weft paths of a number of wefts in a second fabric in accordance with another embodiment of the present invention.

Now, additionally referring to FIG. 3, there is illustrated a partial representation of a second triple layer fabric, in accordance with another embodiment of the present invention. The full weft paths of two paper side wefts T1 and T2, two binder wefts Bi1 and Bi2 forming binder pair 40*a*, and two wear side wefts (B1, B2) are illustrated.

As with the embodiment illustrated in FIG. 2, the wear side wefts bind only with the machine side warps, the weave repeat being over five machine side yarns to provide a five shaft back. The paper side wefts bind only with the paper side warps in the paper side fabric where they each weave in an over-under fashion, to provide a plain weave face. The binder yarns are disposed in pairs with the members of illustrated pair 40*a* binding with a paper side warp and with a multiple of wear side warps.

The arrangement shown in FIG. 3 is substantially similar to that shown in FIG. 2. However, a significant difference is that when binder yarn Bi2 interlaces with paper side warp yarn 7 the adjacent paper side weft yarn T2 does not make a common paper side interlacing with paper side warp 7 but instead T2 provides a top weft fabric stiffening section of three warps duration (5, 7 and 9) by floating under these yarns before interlacing with paper side warps 3 and 11 at the respective ends of the stiffening section. It is not essential that all binder pairs in the fabric be positioned adjacent a top weft, which provides a top weft stiffening section, but at least one binder pair should be so positioned.

Figure 4:
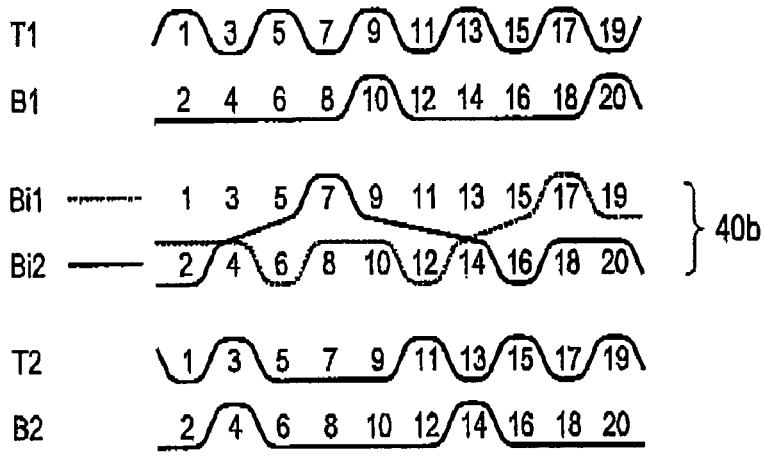
FIG. 4 is a series of warp cross-sectional diagrams showing consecutive weft paths of a number of wefts in a third fabric in accordance with yet another embodiment of the present invention.

Now, additionally referring to FIG. 4, there is illustrated a partial representation of a third triple layer fabric, in accordance with another embodiment of the present invention. The full weft paths of two paper side wefts T1 and T2, two binder wefts Bi1 and Bi2 forming binder pair 40*b*, and two wear side wefts B1 and B2 are illustrated. As with FIGS. 2 and 3, the wear side wefts bind only with the machine side warps, the weave repeat being over five machine side yarns to provide a five shaft back. Likewise the paper side wefts bind only with the paper side warps in the paper side fabric where they each weave in an over-under fashion to provide a plain weave face. The binder yarns are disposed in pairs with the members of pair 40*b* binding with a paper side warp and with a multiple of wear side warps.

The arrangement shown in FIG. 4 is similar to that shown in FIG. 3. However, in contrast to FIG. 3, binder yarn Bi1 provides a fabric stiffening binder section by interlacing with wear side warp 6 and floating over wear side warps 8 and 10 before binding with wear side warp 12. Similarly, binder yarn Bi2 provides a fabric stiffening binder section by interlacing with wear side warp 16 and floating over wear side warps 18 and 20 before binding with wear side warp 2. In this way the embodiment shown in FIG. 4 has fabric stiffening sections provided by the two binders in addition to a top weft fabric stiffening section of three warps duration (5, 7 and 9) provided by paper side weft T2. As with the prior embodiment, it is not essential that all binder pairs in the fabric be positioned adjacent a top weft, which provides a top weft stiffening section, but at least one binder pair should be so positioned. Nor is it essential that all binder pairs provide stiffening sections, but at least one pair should do so.

Figure 5:
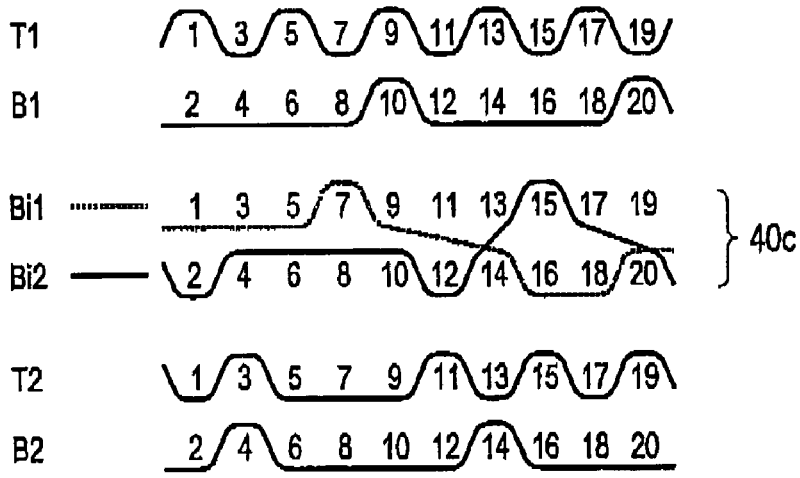
FIG. 5 is a series of warp cross-sectional diagrams showing consecutive weft paths of a number of wefts in a fourth fabric in accordance with still another embodiment of the present invention.

Now, additionally referring to FIG. 5, there is illustrated a partial representation of a fourth triple layer fabric, in accordance with yet another embodiment of the present invention. The full weft paths of two paper side wefts T1 and T2, two binder wefts Bi1 and Bi2 forming binder pair 40*c*, and two wear side wefts B1 and B2 are illustrated. As with the previous embodiments, the wear side wefts bind only with the machine side warps, the weave repeat being over five machine side yarns to provide a five shaft back. Likewise, the paper side wefts bind only with the paper side warps in the paper side fabric where they each weave in an over-under fashion to provide a plain weave face. The binder yarns are disposed in pairs with the members of pair 40*c* binding with a paper side warp and with a multiple of wear side warps.

The binder arrangement shown in FIG. 5 is somewhat different to those previously shown in that binder Bi2 provides a fabric stiffening binder section of four warps duration by interlacing with wear side warp yarns 2 and 12, but floating over warps 4, 6, 8 and 10. Binder Bi1 of pair 40*c* does not provide any stiffening section. An additional fabric stiffening section is provided by top weft T2 where it floats under three paper side warps 5, 7 and 9. As with the prior embodiment, it is not essential that all binder pairs in the fabric be positioned adjacent a top weft, which provides a top weft stiffening section, but at least one binder pair should be so positioned. Nor is it essential that all binder pairs contain a binder providing stiffening sections, but at least one pair should do so.

Figure 6:
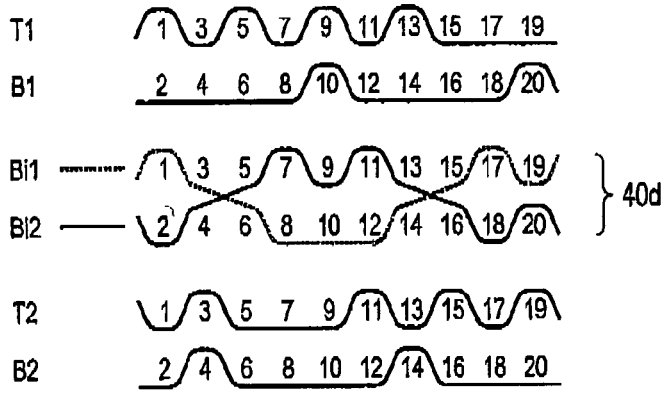
FIG. 6 is a series of warp cross-sectional diagrams showing consecutive weft paths of a number of wefts in a fifth fabric in accordance with still yet another embodiment of the present invention.

Now, additionally referring to FIG. 6, there is shown a partial representation of a fifth triple layer fabric in accordance with still another embodiment of the present invention. The full weft paths of two paper side wefts T1 and T2, two binder wefts Bi1 and Bi2, forming binder pair 40*d*, and two wear side wefts B1 and B2 are illustrated. As with the previous embodiments, the wear side wefts bind only with the machine side warps, the weave repeat being over five machine side yarns to provide a five shaft back. Likewise, the paper side wefts bind only with the paper side warps in the paper side of the fabric where they each weave in an over-under fashion to provide a plain weave face. The binder yarns are disposed in pairs with the members of pair 40*d* binding with a multiple of paper side warps unlike previous embodiments and also with a multiple of wear side warps.

The binder arrangement shown in FIG. 6 is somewhat different to those previously shown in that both binder wefts Bi1 and Bi2 provide two paper side knuckles with warps 17 and 1 and 7 and 11 respectively. Top wefts T1 and T2 both provide fabric stiffening sections of three warps duration by, interlacing with paper side warp yarns 13 and 1 but floating under warps 15, 17 and 19 and, in the case of T2, interlacing with paper side warp yarns 3 and 11 but floating under warps 5, 7 and 9.

As with the prior embodiment, it is not essential that all binder pairs in the fabric are positioned adjacent two top wefts, which provide a top weft stiffening section, but at least one binder pair should be so positioned.

Still referring to FIG. 6 the respective pair members of binder pair 40*d* each provide two paper side weft knuckles; binder Bi1 with warps 17 and 1 and binder Bi2 with warps 7 and 11. Furthermore, the two paper side weft knuckles provided by each of binders Bi1 and Bi2 are equal in number to the number of wear side floats provided by each of the binders.

Figure 7:
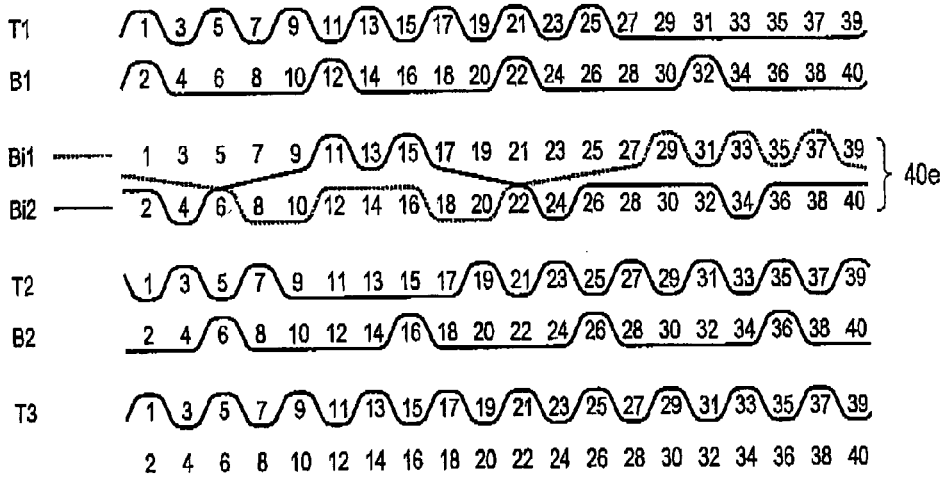
FIG. 7 is a series of warp cross-sectional diagrams showing consecutive weft paths of a number of wefts in a sixth fabric in accordance with a further embodiment of the present invention.

Now, additionally referring to FIG. 7, there is illustrated a partial representation of a sixth triple layer fabric in accordance with a further embodiment of the present invention. The full weft paths of three paper side wefts T1, T2 and T3, two binder wefts Bi1 and Bi2 forming binder pair 40*e*, and two wear side wefts B1 and B2 are illustrated. As with the previous embodiments, the wear side wefts bind only with the machine side warps, the weave repeat being over five machine side yarns to provide a five shaft back. Likewise, the paper side wefts bind only with the paper side warps in the paper side fabric where they each weave in an over-under fashion to provide a plain weave face. The binder yarns are disposed in pairs with the members of pair 40*e* binding with multiple paper side warps and multiple wear side warps.

The binder arrangement shown in FIG. 7 is somewhat different to those previously shown in that a forty shaft weave repeat is shown in which neither member Bi1 or Bi2 of binder group 40*e* provide paper side knuckles over common paper side warp yarns with the respective directly adjacent paper side weft yarns T1 and T2. Binder yarn Bi1 provides paper side knuckles above paper side warps 29, 33 and 37, whereas directly adjacent paper side weft yarn T1 does not. Similarly, binder yarn Bi2 provides paper side knuckles above paper side warps 11 and 15, whereas directly adjacent paper side weft yarn T2 does not. Furthermore, the extended fabric repeat size of 40 warp yarns, which allows the extended interaction of binder and paper side warp yarns, also allows binder B2 to provide two fabric stiffening binder sections each of four warps duration by interlacing with wear side warp yarns 24, 34 and 4 but floating over warps 26, 28, 30 and 32, and 36, 38, 40 and 2. Binder Bi1 of pair 40*e* provides a further stiffening section above wear side yarns 12, 14 and 16. Two additional fabric stiffening sections, of seven and five warp yarns duration, are provided by top weft T1 and T2 where they float, respectively, under paper side warps 27, 29, 31, 33, 35, 37 and 39, and 9, 11, 13, 15 and 17.

A further different feature of FIG. 7, as compared to the prior embodiments, is that at least one of the binder pair members provides more paper side knuckles or floats than it provides wear side knuckles or floats. Binder 11 provides three paper side knuckles over warps 29, 33 and 37, respectively, whereas only two wear side floats are provided under warps 8 and 10 and 18 and 20.

As with the prior embodiment, it is not essential that all binder pairs in the fabric be positioned adjacent a top weft, which provides a top weft stiffening section, but at least one binder pair should be so positioned. Nor is it essential that all binder pairs contain a binder providing stiffening sections, but at least one pair should do so.

Alternatively, embodiments can be provided wherein at least one binder pair has a first binder, which interlaces with a first number of paper side warp yarns and a second binder interlaces with a second number of paper side warp yarns and the first number is different from the second number. It is to be understood that the above-described embodiments are by way of illustration only. Many modifications and variations are possible.

Various "effective" paper side to wear side weft ratios can be used i.e. 2:1 as shown in FIG. 2, but also 1:1, 3:1, 3:2, and 4:3, for example. The selected "effective" paper side to wear side weft ratio is a trade off between optimizing the fabric paper side properties and optimizing the fabric wear side properties. Similarly the ratio of warp in the paper side and wear side fabrics may be chosen from the group including 1:1 as shown, but also 2:1, 3:1, 3:2 and 4:3, for example.

The ratio of paper side weft yarns to binder yarn pairs is preferably, but not exclusively, selected from the group including 1:1, 2:1, 3:1, 4:1, 5:1 and 6:1.

The material chosen for individual members of a binder pair may be the same or different from that chosen for the paper side weft material to allow optimizing of properties such as paper side surface smoothness, or binding integrity of the fabric. Similarly, members of a binder pair may be provided in materials of dissimilar mechanical properties particularly where the interlacing frequency or yarn path is not identical.

The weave selected for the paper side fabric is not restricted to plain weave, but may be selected from the group including regular or irregular satins or sateens, twills, modified twills or other modified weaves.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A forming fabric, comprising:

a plurality of paper side weft yarns;

a plurality of binder weft yarns disposed in at least one group of at least two of said plurality of binder weft yarns;

a plurality of paper side warp yarns interlaced with said plurality of paper side weft yarns and said plurality of binder weft yarns;

a plurality of machine side weft yarns; and a plurality of machine side warp yarns interlaced with said plurality of machine side weft yarns and said plurality of binder weft yarns, whereby said plurality of binder weft yarns form fewer knuckles over said plurality of paper side warp yarns than said plurality of paper side weft yarns.

2. The forming fabric of claim 1, wherein both said binder weft yarns of at least one binder group float below at least two consecutive paper side warp yarns.

3. The forming fabric of claim 1, wherein both of said binder weft yarns of at least one binder group flow below a plurality of at least two consecutive paper side warp yarns.

4. The forming fabric of claim 1, wherein both said binder weft yarns of at least one binder group in total pass more often below said machine side warp yarns than above said paper side warp yarns.

5. The forming fabric of claim 1, wherein at least one binder weft yarn of said at least one binder group passes above only one paper side warp yarn to form a knuckle and passes below a plurality of machine side warp yarns.

6. The forming fabric of claim 1, wherein each of said binder weft yarns of said at least one binder group pass above only one paper side warp yarn and below a plurality of machine side warp yarns.

7. The forming fabric of claim 1, wherein at least one binder weft yarn of said at least one binder group has an equal number of bindings with said machine side warp yarns and said paper side warp yarns.

8. The forming fabric of claim 1, wherein at least one binder weft yarn of said at least one binder group passes more often above said paper side warp yarns than below said machine side warp yarns.

9. The forming fabric of claim 1, wherein a binder weft yarn of said at least one binder group and a paper side weft yarn of said plurality of paper side weft yarns are positioned adjacent said binder group thereby forming knuckles over a common paper side warp yarn.

10. The forming fabric of claim 9, wherein said binder weft yarn and said paper side weft yarn are separated by at least one of at least one binder weft yarn and a paper side weft yarn that passes below said common paper side warp yarn.

11. The forming fabric of claim 1, wherein a plurality of pairs of warp yarns are each defined as one of said plurality of paper side warp yarns and a corresponding one of said plurality of machine side warp yarns, at least one of said plurality of binder weft yarns floating between at least two consecutive pairs of warp yarns before traveling one of from a paper side of the fabric to a machine side of the fabric and from said machine side of the fabric to said paper side of the fabric.

12. The forming fabric of claim 1, wherein a plurality of pairs of warp yarns are each defined as one of said plurality of paper side warp yarns and a corresponding one of said plurality of machine side warp yarns, at least one of said plurality of binder weft yarns float between at least two consecutive pairs of warp yarns and is bound at each end of said float by one of said paper side warp yarns and said machine side warp yarns, thereby forming a fabric stiffening binder yarn section.

13. The forming fabric of claim 1, wherein at least one of said plurality of paper side weft yarns is positioned adjacent to said group of at least two binder weft yarns, said at least one of said plurality of paper side weft yarns floating under at least two consecutive said paper side warp yarns, at least one of said binder weft yarns of said binder group forming a knuckle over one of the said at least two consecutive paper side warp yarns.

14. The forming fabric of claim 13, wherein said at least one of said plurality of paper side weft yarns floats under an odd number of said consecutive paper side warp yarns.

15. The forming fabric of claim 14, wherein said at least one of said plurality of paper side weft yarns floats under one of 3, 5 and 7 of said consecutive paper side warp yarns.

16. The forming fabric of claim 13, wherein a plurality of pairs of warp yarns are each defined as one of said plurality of paper side warp yarns and a corresponding one of said plurality of machine side warp yarns, said at least one of said plurality of paper side weft yarns floating between said warp yarns of each of at least two consecutive said pairs.

17. The forming fabric of claim 1, wherein at least one of said plurality of paper side warp yarns, said plurality of paper side weft yarns, said plurality of machine side warp yarns, said plurality of machine side weft yarns and said plurality of binder weft yarns have a different yarn diameter.

18. The forming fabric of claim 1, wherein at least one of said at least two binder weft yarns of said binder group has a different yarn diameter.

19. The forming fabric of claim 1, wherein the fabric has one of a 16 warp, a 20 warp, a 24 warp, a 28 warp, a 32 warp and a 40 warp repeat.

20. The forming fabric of claim 1, wherein the fabric has a greater than 40 warp repeat.

21. The forming fabric of claim 1, wherein said plurality of machine side wefts are single interlaced with said plurality of machine side warps over one of a 5 shaft repeat and a 6 shaft repeat.

22. The forming fabric of claim 1, wherein said plurality of machine side warps make multiple non-adjacent interlacings with said plurality of machine side wefts over one of an 8 shaft repeat and a 10 shaft repeat.

23. The forming fabric of claim 1, wherein at least some of said yarns are interlaced to form a weave on a paper side of the fabric, said weave one of a plain weave, a twill weave and a sateen weave.

24. The forming fabric of claim 1, wherein the fabric has a permeability of from approximately 200 c.f.m. to approximately 1,000 c.f.m.

25. A method of manufacturing a fiber web, comprising the steps of:

providing a forming fabric, including:

a plurality of paper side weft yarns;

a plurality of binder weft yarns disposed in at least one group of at least two of said plurality of binder weft yarns;

a plurality of paper side warp yarns interlaced with said plurality of paper side weft yarns and said plurality of binder weft yarns;

a plurality of machine side weft yarns; and a plurality of machine side warp yarns interlaced with said plurality of machine side weft yarns and said plurality of binder weft yarns, whereby said plurality of binder weft yarns form fewer knuckles over said plurality of paper side warp yarns than said plurality of paper side weft yarns; and forming the fiber web using at least one said forming fabric.

* * * * *